US011441813B2

(12) United States Patent
Tsuji et al.

(10) Patent No.: US 11,441,813 B2
(45) Date of Patent: Sep. 13, 2022

(54) INDOOR UNIT OF REFRIGERATION APPARATUS

(71) Applicant: DAIKIN INDUSTRIES, LTD., Osaka (JP)

(72) Inventors: Yoshiyuki Tsuji, Osaka (JP); Makoto Kojima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/572,890

(22) Filed: Jan. 11, 2022

(65) Prior Publication Data

US 2022/0128267 A1 Apr. 28, 2022

Related U.S. Application Data

(63) Continuation of application No. PCT/JP2020/026929, filed on Jul. 9, 2020.

(30) Foreign Application Priority Data

Jul. 12, 2019 (JP) ..... JP2019-130645

(51) Int. Cl.
*F24F 13/22* (2006.01)

(52) U.S. Cl.
CPC ..... *F24F 13/222* (2013.01)

(58) Field of Classification Search
CPC ..... F24F 13/222
USPC ..... 62/291
See application file for complete search history.

(56) References Cited

U.S. PATENT DOCUMENTS

| | | | | |
|---|---|---|---|---|
| 8,327,656 | B2 * | 12/2012 | Tutunoglu | F25B 49/02 62/126 |
| 10,731,884 | B2 * | 8/2020 | Blanton | F24F 11/77 |
| 10,760,839 | B2 * | 9/2020 | Yamaguchi | F24F 13/20 |
| 11,125,457 | B1 * | 9/2021 | Alfano | F24F 11/56 |
| 11,262,104 | B2 * | 3/2022 | Uraguchi | F25B 1/00 |
| 2012/0031130 | A1 * | 2/2012 | Morimoto | F25B 41/40 62/196.1 |

(Continued)

FOREIGN PATENT DOCUMENTS

| | | | |
|---|---|---|---|
| EP | 3279590 | A1 | 2/2018 |
| EP | 3306237 | A1 | 4/2018 |

(Continued)

OTHER PUBLICATIONS

International Search Report issued in corresponding International Application No. PCT/JP2020/026929, dated Sep. 8, 2020 (5 pages).

(Continued)

*Primary Examiner* — Filip Zec
(74) *Attorney, Agent, or Firm* — Osha Bergman Watanabe & Burton LLP

(57) ABSTRACT

An indoor unit of a refrigeration apparatus includes: a drain pan that includes four wall surfaces including a first wall surface, and has a quadrangle shape in a plan view; a heat exchanger disposed above the drain pan and through which a combustible refrigerant, having a larger specific gravity than air, flows; a fan that generates air flow to the heat exchanger; a gas sensor that detects a refrigerant leakage; and a casing accommodating the drain pan, the heat exchanger, the fan, and the gas sensor.

9 Claims, 9 Drawing Sheets

(56) References Cited

U.S. PATENT DOCUMENTS

| | | | | |
|---|---|---|---|---|
| 2016/0109162 | A1* | 4/2016 | Suzuki | F24F 11/30 62/498 |
| 2017/0198936 | A1 | 7/2017 | Yamaguchi | |
| 2017/0284718 | A1 | 10/2017 | Suzuki et al. | |
| 2020/0072508 | A1 | 3/2020 | Uraguchi et al. | |
| 2020/0318887 | A1* | 10/2020 | Tsutsumi | F25D 21/14 |

FOREIGN PATENT DOCUMENTS

| | | | |
|---|---|---|---|
| JP | H08-061702 | A | 3/1996 |
| JP | 2002-098346 | A | 4/2002 |
| JP | 2006-097995 | A | 4/2006 |
| JP | 2013076487 | A | 4/2013 |
| JP | 2014081160 | A | 5/2014 |
| JP | 2015-224837 | A | 12/2015 |
| JP | 2016-070568 | A | 5/2016 |
| JP | 2016-188757 | A | 11/2016 |
| JP | 2019-011914 | A | 1/2019 |
| WO | 2015-194596 | A1 | 12/2015 |
| WO | 2018216052 | A1 | 11/2018 |

OTHER PUBLICATIONS

International Preliminary Report on Patentability issued in corresponding International Application No. PCT/JP2020/026929 dated Jan. 27, 2022 (5 pages).

Extended European Search Report issued in corresponding European Application No. 20840735.3, dated Jul. 29, 2022 (7 pages).

* cited by examiner

INDOOR UNIT OF REFRIGERATION APPARATUS

TECHNICAL FIELD

The present disclosure relates to an indoor unit of a refrigeration apparatus configured to detect refrigerant leakage.

BACKGROUND

In recent years, an air conditioner adopting a refrigerant having low global warming potential (GWP) (hereinafter, called low GWP refrigerants) is introduced into a market in view of environmental protection. Examples of the low GWP refrigerant include a flammable refrigerant disclosed in Patent Literature 1 (JP 2019-11914 A).

SUMMARY

An indoor unit of a refrigeration apparatus according to one or more embodiments of the present disclosure includes a drain pan, a heat exchanger, a fan, a gas sensor, and a casing. The drain pan has four wall surfaces including a first wall surface and has a quadrangle shape in a plan view. The heat exchanger is installed above the drain pan, and a combustible refrigerant having a larger specific gravity than air flows through the heat exchanger. The fan generates an air flow to the heat exchanger. The gas sensor detects leakage of the refrigerant. The casing accommodates the drain pan, the heat exchanger, the fan, and the gas sensor. The casing has a plurality of side plates, a partition plate, and a blow-out port. The plurality of side plates constitutes side surfaces of an outer contour. The partition plate divides an internal space surrounded by the plurality of side plates into a first chamber and a second chamber. The drain pan is installed in the first chamber. The fan is installed in the second chamber. The blow-out port is formed on a first side plate, which is one of the plurality of side plates. The first side plate faces the first wall surface of the drain pan. The wall surfaces other than the first wall surface of the drain pan are arranged along the side plates or the partition plate. An installation position of the gas sensor is above the drain pan, and a height H from an upper end of the drain pan to the gas sensor satisfies a relational expression represented by $$L \cdot W\{C1 \cdot H1/Q + C2 \cdot H/(Q - C3 \cdot L \cdot H^{(3/2)})\} \leq 90, \text{ where}$$

constant C1: 0.0067, constant C2: 0.01172, constant C3: 0.000153,

L [m]: a length of the first wall surface of the drain pan,

W [m]: a length of the wall surface of the drain pan intersecting the first wall surface, H1 [m]: a depth of the drain pan, and Q [m^3/s]: a refrigerant leakage flow rate.

DETAILED DESCRIPTION (1) Air Conditioner 10

Description will be made herein about an air conditioner 10 as an exemplary refrigeration apparatus.

Figure 1:
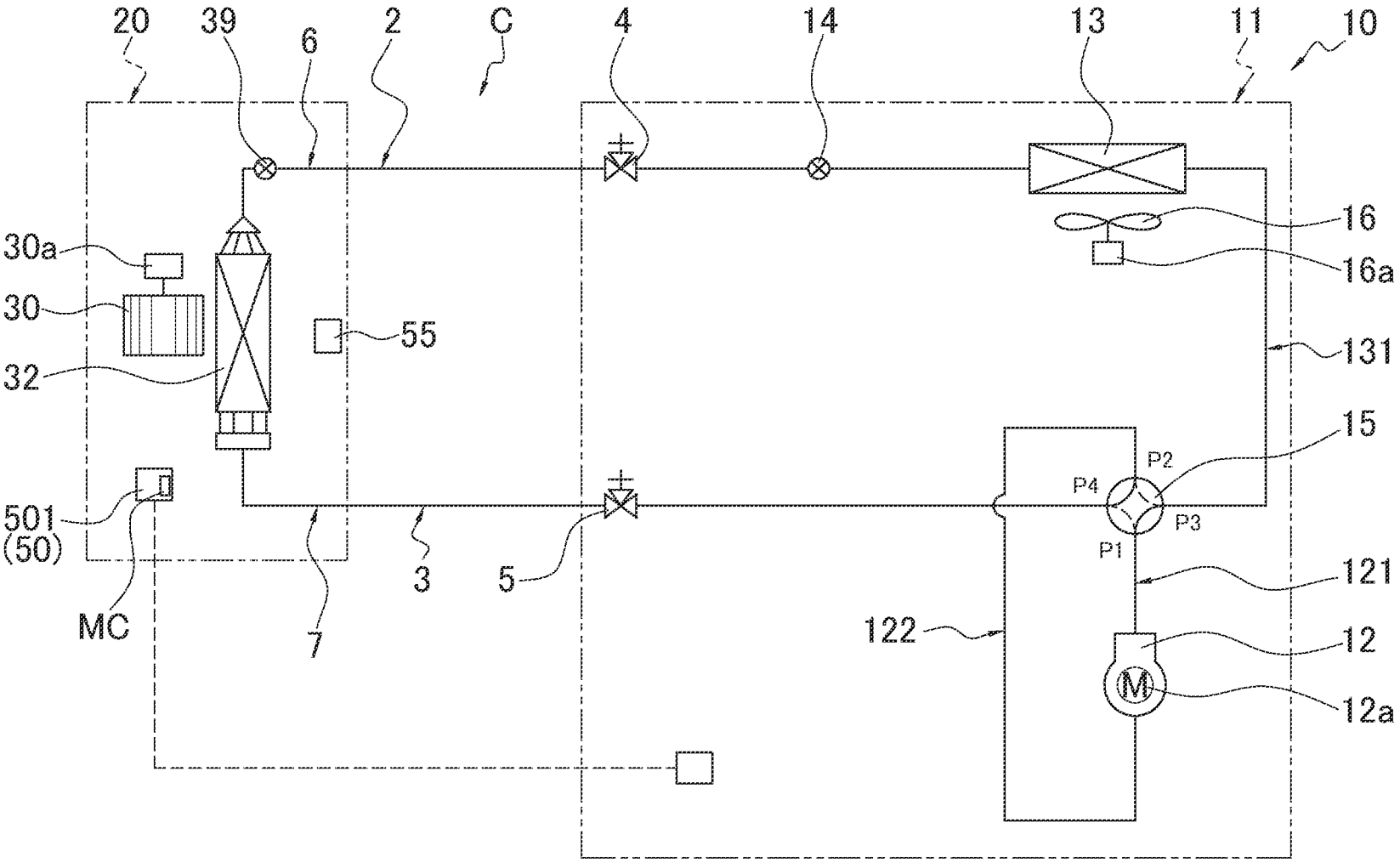
FIG. 1 is a piping diagram depicting a configuration of a refrigerant circuit in an air conditioner according to one or more embodiments of the present disclosure.

FIG. 1 is a piping diagram depicting a configuration of a refrigerant circuit C in the air conditioner 10 according to one or more embodiments of the present disclosure. The air conditioner 10 depicted in FIG. 1 cools and heats air in a room. As depicted in FIG. 1, the air conditioner 10 includes an outdoor unit 11 disposed outdoors and an indoor unit 20 installed in the room. The outdoor unit 11 and the indoor unit 20 are connected to each other by two connection pipes 2 and 3. The refrigerant circuit C is accordingly constituted in the air conditioner 10. The refrigerant circuit C is filled with a refrigerant that circulates to achieve a vapor compression refrigeration cycle.

The refrigerant sealed in the refrigerant circuit C is a flammable refrigerant. Examples of the flammable refrigerant include refrigerants categorized in Class 3 (higher flammability), Class 2 (lower flammability), and Subclass 2L (slight flammability) in the standards according to ASHRAE 34 Designation and safety classification of refrigerant in the U.S.A. or the standards according to ISO 817 Refrigerants—Designation and safety classification.

Exemplarily adopted as the combustible refrigerant is any of R1234yf, R1234ze(E), R516A, R445A, R444A, R454C, R444B, R454A, R455A, R457A, R459B, R452B, R454B, R447B, R32, R447A, R446A, or R459A.

One or more embodiments employ R32 as the refrigerant.

(1-1) Outdoor Unit 11

The outdoor unit 11 is provided with a compressor 12, an outdoor heat exchanger 13, an outdoor expansion valve 14, and a four-way switching valve 15.

(1-1-1) Compressor 12

The compressor 12 compresses a low-pressure refrigerant and discharges a high-pressure refrigerant obtained by compression. The compressor 12 includes any one of a compression mechanism of a scroll type, a rotary type, or the like driven by a compressor motor 12*a*. An operating frequency of the compressor motor 12*a* is variable by means of an inverter device.

As depicted in FIG. 1, there is provided a discharge pipe 121 connecting a refrigerant discharge port of the compressor 12 and the four-way switching valve 15. There is further provided a suction pipe 122 connecting a suction port of the compressor 12 and the four-way switching valve 15.

(1-1-2) Outdoor Heat Exchanger 13

The outdoor heat exchanger 13 is of a fin-and-tube heat exchanger. There is installed an outdoor fan 16 adjacent to the outdoor heat exchanger 13. The outdoor heat exchanger 13 causes heat exchange between air conveyed by the outdoor fan 16 and a refrigerant flowing in the outdoor heat exchanger 13.

As depicted in FIG. 1, there is provided a first pipe 131 connecting a refrigerant inflow port of the outdoor heat exchanger 13 and the four-way switching valve 15 during cooling operation.

(1-1-3) Outdoor Expansion Valve 14

The outdoor expansion valve 14 is an electronic expansion valve having a variable opening degree. The outdoor expansion valve 14 is installed downstream of the outdoor heat exchanger 13 in a refrigerant flow direction in the refrigerant circuit C during cooling operation.

The opening degree of the outdoor expansion valve 14 is fully opened during cooling operation. In contrast, during heating operation, the opening degree of the outdoor expansion valve 14 is adjusted such that a refrigerant flowing into the outdoor heat exchanger 13 is decompressed up to a pressure enabling evaporation (evaporation pressure) in the outdoor heat exchanger 13.

(1-1-4) Four-Way Switching Valve 15

The four-way switching valve 15 has first to fourth ports. At the four-way switching valve 15, a first port P1 is connected to the discharge pipe 121 of the compressor 12, a second port P2 is connected to the suction pipe 122 of the compressor 12, a third port P3 is connected to the first pipe 131 of the outdoor heat exchanger 13, and a fourth port P4 is connected to a gas shutoff valve 5.

The four-way switching valve 15 is switched between a first state (state indicated by solid lines in FIG. 1) and a second state (state indicated by broken lines in FIG. 1). At the four-way switching valve 15 in the first state, the first port P1 and the third port P3 communicate with each other and the second port P2 and the fourth port P4 communicate with each other. At the four-way switching valve 15 in the second state, the first port P1 and the fourth port P4 communicate with each other and the second port P2 and the third port P3 communicate with each other.

(1-1-5) Outdoor Fan 16

The outdoor fan 16 is composed of a propeller fan driven by an outdoor fan motor 16*a*. An operating frequency of the outdoor fan motor 16*a* is variable by means of an inverter device.

(1-1-6) Liquid Connection Pipe 2 and Gas Connection Pipe 3

The two connection pipes include the liquid connection pipe 2 and the gas connection pipe 3. The liquid connection pipe 2 has one end connected to a liquid shutoff valve 4 and the other end connected to a liquid connection tube 6 of an indoor heat exchanger 32. As depicted in FIG. 1, the liquid connection tube 6 is connected directly or indirectly to a refrigerant inlet of the indoor heat exchanger 32 during cooling operation.

The gas connection pipe 3 has one end connected to the gas shutoff valve 5 and the other end connected to a gas connection tube 7 of the indoor heat exchanger 32. As depicted in FIG. 1, the gas connection tube 7 is connected directly or indirectly to a refrigerant outlet of the indoor heat exchanger 32 during cooling operation.

(1-2) Indoor Unit 20

Figure 2:
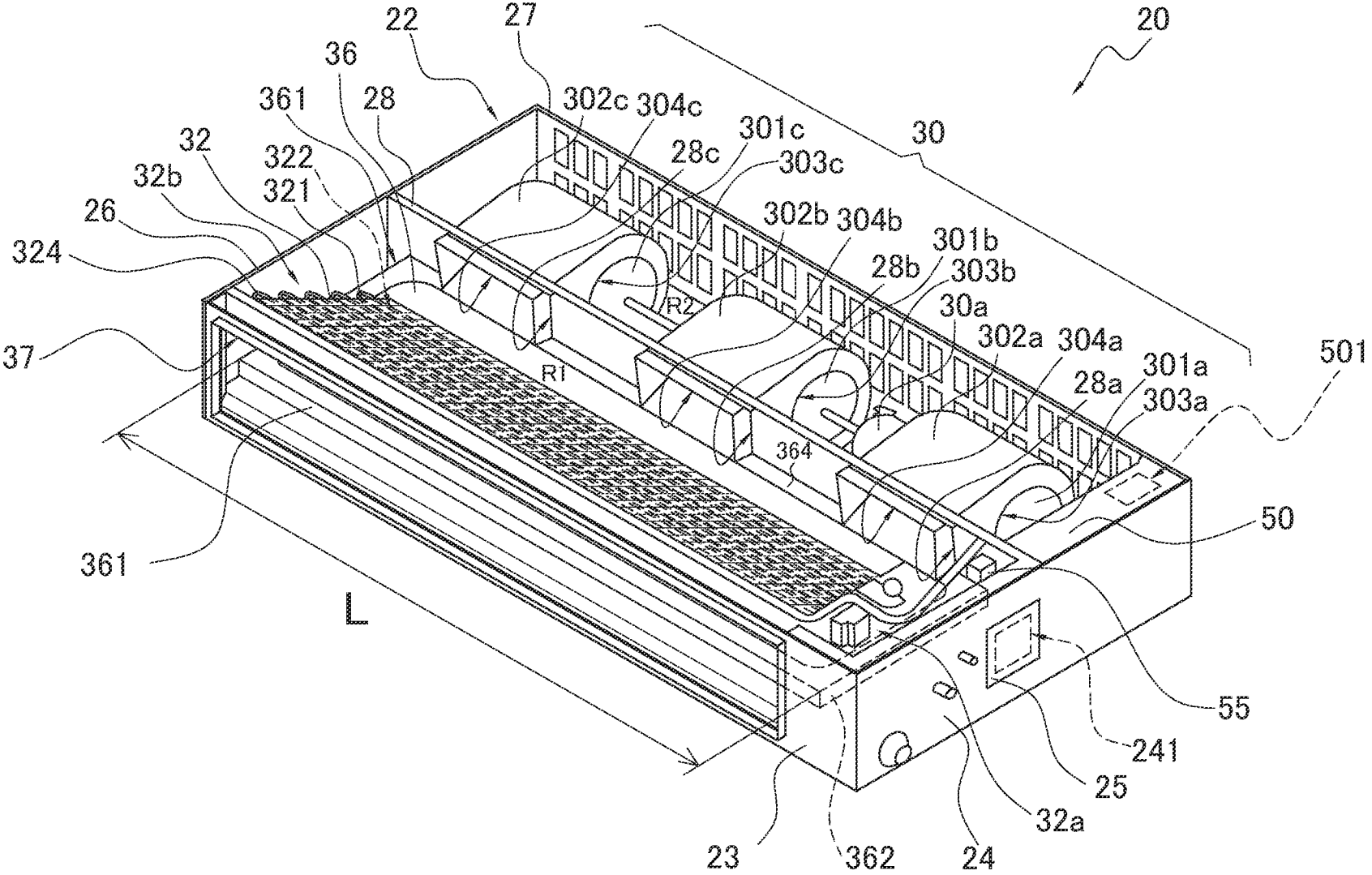
FIG. 2 is a perspective view of an indoor unit of an air conditioner according to one or more embodiments of the present disclosure.
Figure 3:
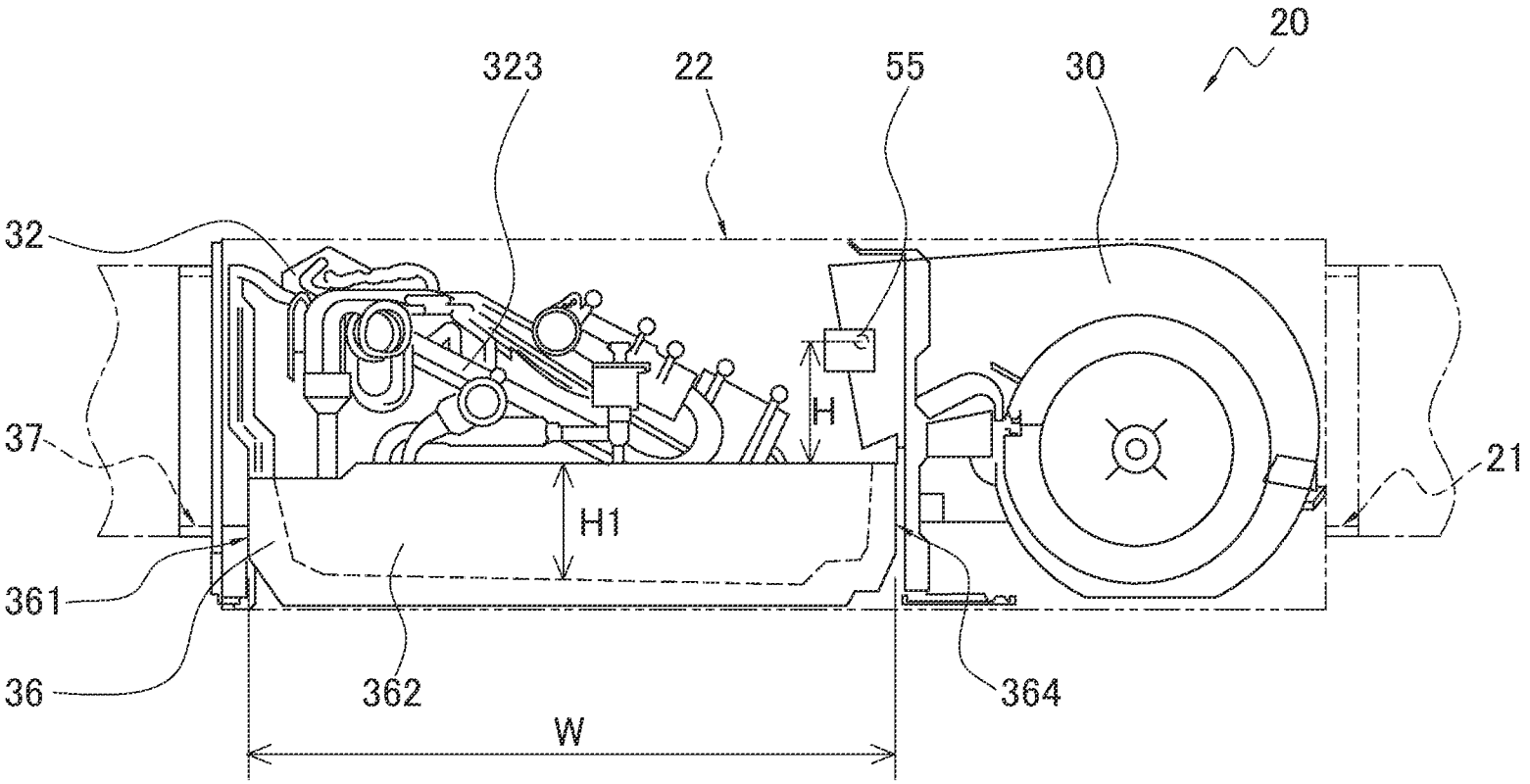
FIG. 3 is a side view of the indoor unit.

FIG. 2 is a perspective view of the indoor unit 20 of an air conditioner according to one or more embodiments of the present disclosure, in which an upper surface of the casing 22 is removed. FIG. 3 is a side view of the indoor unit 20 of the air conditioner, and the casing 22 is indicated by a chain double-dashed line.

In FIGS. 2 and 3, the indoor unit 20 is installed in an attic space of a building or the like, and includes the casing 22, an indoor fan 30, the indoor heat exchanger 32, a drain pan 36, and a gas sensor 55. The casing 22 has a ventilation space. In FIG. 3, the ventilation space is an internal space in which air flows from a fourth side plate 27 of the casing 22 toward a first side plate 23 of the casing 22. In the ventilation space, the indoor fan 30 and the indoor heat exchanger 32 are arranged in order from the fourth side plate 27 to the first side plate 23 of the casing.

(1-2-1) Casing 22

The casing 22 has a box shape and has the first side plate 23, a second side plate 24, a third side plate 26, and the fourth side plate 27 that form side surfaces of an outer contour of the casing 22.

The fourth side plate 27 is located on a back surface of the casing 22, and the fourth side plate 27 is provided with a suction port 21. The suction port 21 sucks air into the casing 22 through an inlet duct (indicated by an alternate long and short dash line in FIG. 3).

Further, the first side plate 23 is located on a front surface of the casing 22, and the first side plate 23 is provided with a blow-out port 37. The blow-out port 37 blows air that has passed through the indoor heat exchanger 32 to outside of the casing 22 through an outlet duct (indicated by an alternate long and short dash line in FIG. 3).

The second side plate 24 is provided with an opening 241. The opening 241 is used for replacing a drain pump (not shown) that discharges condensed water accumulated in the drain pan 36. The opening 241 is also used for replacing the gas sensor 55. The opening 241 is closed by a lid 25 except when the drain pump or the gas sensor is replaced.

(1-2-2) Partition Plate 28

The partition plate 28 divides the ventilation space into a first chamber R1 and a second chamber R2. The second chamber R2 communicates with the suction port 21. The indoor fan 30 is installed in the second chamber R2. The first chamber R1 communicates with the blow-out port 37. The indoor heat exchanger 32 and the drain pan 36 are installed in the first chamber R1.

Further, the partition plate 28 is plate-shaped and is installed so as to be parallel to the front surface and the back surface of the casing 22. The partition plate 28 is provided with three openings 28*a*, 28*b*, and 28*c* aligned side by side. The three openings 28*a*, 28*b*, and 28*c* are aligned parallel to the front surface and the back surface of the casing 22.

(1-2-3) Indoor Fan 30

The indoor fan 30 is disposed in the second chamber R2. The indoor fan 30 sucks air into the second chamber R from the suction port 21 and blows air into the first chamber R1 through the openings 28*a*, 28*b*, and 28*c* of the partition plate 28. The indoor fan 30 is a double-suction sirocco fan. The indoor fan 30 includes three impellers 301*a*, 301*b*, and 301*c*, three scroll casings 302*a*, 302*b*, and 302*c* accommodating the impellers 301*a*, 301*b*, and 301*c*, respectively, and a motor 30*a* that drives the impellers 301*a*, 301*b*, and 301*c*.

The impellers 301*a*, 301*b*, and 301*c* are aligned side by side toward a side of the casing 22. The scroll casings 302*a*, 302*b*, and 302*c* have three scroll suction ports 303*a*, 303*b*, and 303*c*, respectively, formed on both side surfaces, and scroll blow-out ports 304*a*, 304*b*, and 304*c*, respectively, formed on the front surface. The scroll blow-out ports 304*a*, 304*b*, and 304*c* are arranged so as to respectively correspond to the openings 28*a*, 28*b*, and 28*c* of the partition plate 28.

The motor 30*a* is disposed between the scroll casing 302*a* and the scroll casing 302*b* in a plan view of the casing 22, and a shaft is connected to the two impellers 301*a* and 301*b*. The impeller 301*b* and the impeller 301*c* are connected to each other by a shaft.

The indoor fan 30 is not limited to a configuration in which a plurality of double-suction sirocco fans are driven by one motor 30*a* as described above. The number of sirocco fans may be two, and the number of motors may be different. Alternatively, the indoor fan 30 may be a fan other than a sirocco fan.

(1-2-4) Indoor Heat Exchanger 32

The indoor heat exchanger 32 is disposed in the first chamber R1. The indoor heat exchanger 32 exchanges heat between the air blown from the scroll blow-out ports 304*a*, 304*b*, and 304*c* into the first chamber R1 and the refrigerant flowing through the indoor heat exchanger 32.

The indoor heat exchanger 32 is a cross-fin-tube heat exchanger. The indoor heat exchanger 32 has a plurality of fins 321, a plurality of heat transfer tubes 322, a collection tube 323 (FIG. 3), and a connection tube 324. The fins 321 are rectangular thin plates including a metal having high thermal conductivity, for example, aluminum or an aluminum alloy. The fins 321 are each provided with a plurality of through holes penetrating in a plate thickness direction. The plurality of fins 321 are layered at regular intervals.

The heat transfer tubes 322 are copper tubes. The heat transfer tubes 322 are inserted into the through holes of the fins 321 and then expanded to come into close contact with the fins 321. The collection tube 323 is connected to one end of the plurality of heat transfer tubes 322. The connection tube 324 connects the heat transfer tubes 322 to each other at the other end of the plurality of heat transfer tubes 322 (i.e., the connection tube 324 is connected to the other end of the plurality of heat transfer tubes 322).

For convenience of explanation, among ends of the indoor heat exchanger 32, an end on a side where the collection tubes 323 are located is referred to as a first end 32*a*, and an end on a side where the connection tube 324 is located is referred to as a second end 32*b*.

The indoor heat exchanger 32 is inclined toward the front surface of the casing 22 from a lower end to an upper end. Further, a combustible refrigerant having a larger specific gravity than air, for example, R32 refrigerant, flows through the indoor heat exchanger 32.

The indoor heat exchanger 32 is not limited to a cross-fin-tube heat exchanger.

(1-2-5) Drain Pan 36

The drain pan 36 has a first wall surface 361, a second wall surface 362, a third wall surface 363, and a fourth wall surface 364, and has a quadrangle shape in a plan view. The indoor heat exchanger 32 is installed above the drain pan 36, and the drain pan 36 receives water condensed by the indoor heat exchanger 32.

The first wall surface 361 of the drain pan 36 faces the first side plate 23 of the casing 22, and as a result, the blow-out port 37 formed in the first side plate 23 is along the first wall surface 361 of the drain pan 36. The second wall surface 362 of the drain pan 36 is along the second side plate 24 of the casing 22, the third wall surface 363 of the drain pan 36 is along the third side plate 26 of the casing 22, and the fourth wall surface 364 of the drain pan 36 is along the partition plate 28.

(1-2-6) Electric Component Box 50

An electric component box 50 is installed along the side plate 24 of the casing 22 or the partition plate 28. The electric component box 50 includes a control board 501, and the control board 501 is also installed along the side plate 24 or the partition plate 28.

The control board 501 controls devices such as the indoor fan 30 in response to signals from various sensors. The control board 501 is closer to the first end 32*a* where the collection tubes 323 of the indoor heat exchanger 32 are located than to the second end 32*b* where the connection tube 324 of the indoor heat exchanger 32 is located.

(1-2-7) Gas Sensor 55

Figure 4A:
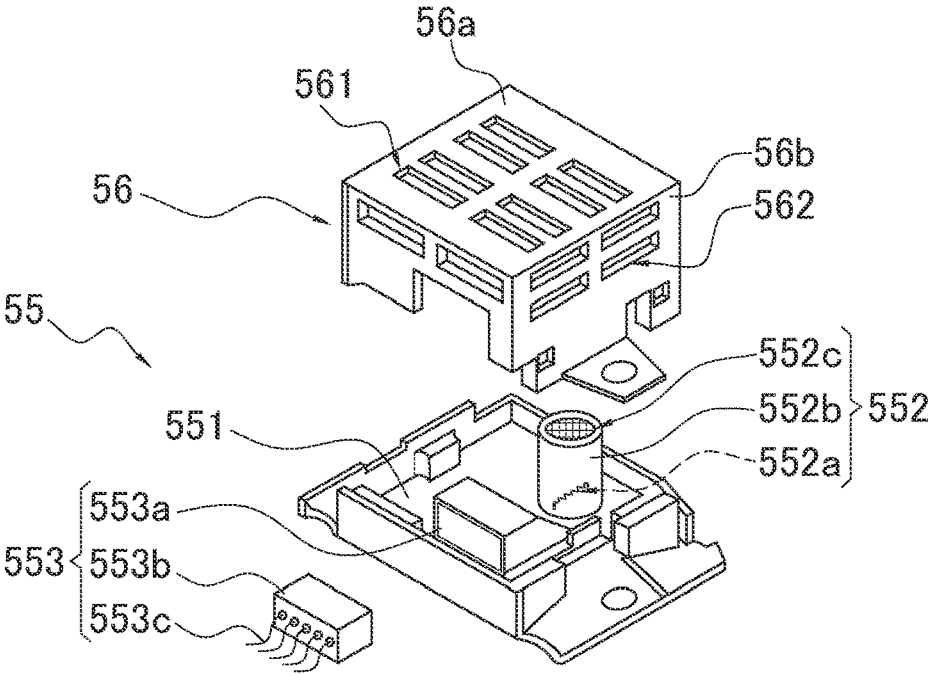
FIG. 4A is a perspective view of a gas sensor to be covered with a case.
Figure 4B:
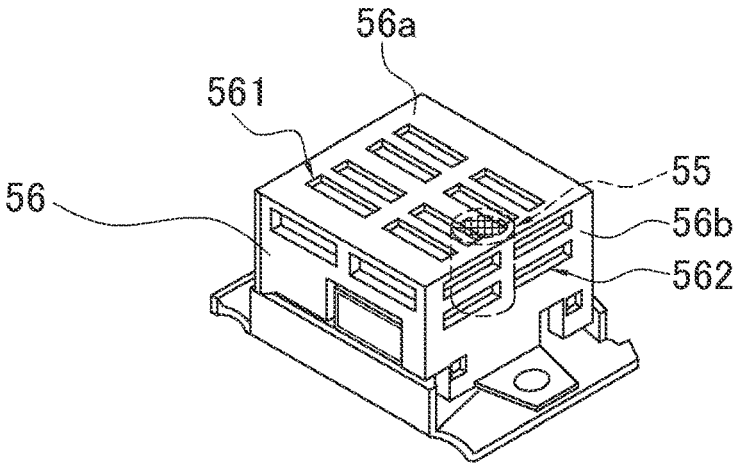
FIG. 4B is a perspective view of the gas sensor covered with the case.

FIG. 4A is a perspective view of the gas sensor 55 to be covered with a case 56. FIG. 4B is a perspective view of the gas sensor 55 covered with the case 56. The gas sensor 55 depicted in FIG. 4A and FIG. 4B detects refrigerant leakage. The gas sensor 55 includes a substrate 551, a sensor unit 552, and a wiring unit 553. The sensor unit 552 includes a sensor element 552*a*, and a cylindrical pipe 552*b* covering the sensor element 552*a*.

The sensor element 552*a* is mounted on the substrate 551 and detects presence or absence of refrigerant gas. The cylindrical pipe 552*b* has an upper end surface provided with a hole 552*c* allowing entry of refrigerant gas.

The wiring unit 553 includes a female connector 553*a* mounted on the substrate 551, a male connector 553*b* fitted to the female connector 553*a*, and a cable 553*c* connected to the male connector 553*b*. The wiring unit 553 electrically connects the sensor element 552*a* and the substrate 551 to each other.

At least the sensor unit 552 of the gas sensor 55 is covered with the case 56 for protection. The case 56 has a first opening 561 for ventilation. The first opening 561 is provided in a surface called a ventilation surface 56*a*.

The ventilation surface 56*a* according to one or more embodiments crosses a side surface 56*b* provided with a second opening 562.

When a refrigerant leaks, part of refrigerant gas entered through the first opening 561 can flow to the sensor unit 552 of the gas sensor 55 and the remainder can exit through the second opening 562. Alternatively, when the refrigerant leaks, part of refrigerant gas entered through the second opening 562 can flow to the sensor unit 552 of the gas sensor 55 and the remainder can exit through the first opening 561.

In one or more embodiments, the ventilation surface 56*a* has a plurality of first openings 561 and the side surface 56*b* has a plurality of second openings 562. There may alternatively be provided a 1 first opening 561 and a 1 second opening 562.

The case 56 exerts two functions of protecting the sensor unit 552 and introducing refrigerant gas as a leaking refrigerant.

Figure 4C:
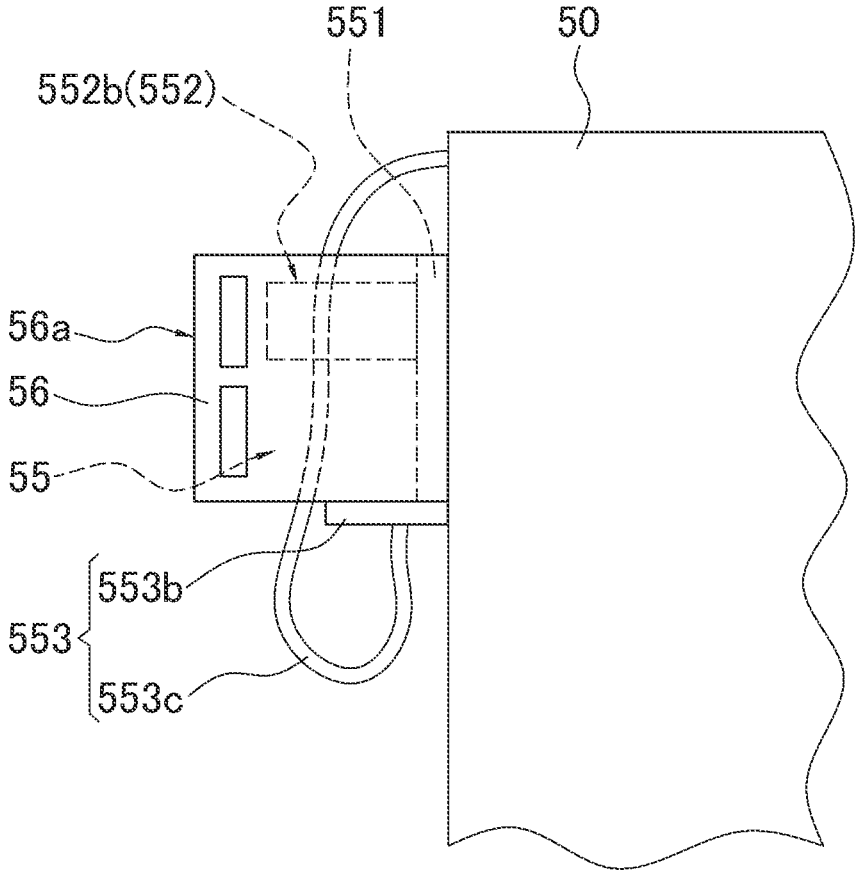
FIG. 4C is an enlarged side view of an installation position of the gas sensor.

FIG. 4C is an enlarged side view of an installation position of the gas sensor 55. In FIG. 4C, the cable 553*c* of the wiring unit 553 is curved to be positioned below the sensor unit 552 and is then introduced into the electric component box 50. This is to prevent water droplets from entering the substrate 551 along the electric wire 553*c* when the water droplets adhere to the electric wire for some reason.

(2) Operation

The air conditioner 10 according to one or more embodiments will be described next in terms of its operation. The air conditioner 10 switches between cooling operation and heating operation.

(2-1) Cooling Operation

During cooling operation, the four-way switching valve 15 depicted in FIG. 1 is in the state indicated by solid lines, and the compressor 12, the indoor fan 30, and the outdoor fan 16 are in an operating state. The refrigerant circuit C thus achieves a refrigeration cycle in which the outdoor heat exchanger 13 functions as a radiator and the indoor heat exchanger 32 functions as an evaporator.

Specifically, a high-pressure refrigerant compressed by the compressor 12 flows in the outdoor heat exchanger 13 to exchange heat with outdoor air. The high-pressure refrigerant radiates heat to the outdoor air in the outdoor heat exchanger 13. A refrigerant condensed by the outdoor heat exchanger 13 is sent to the indoor unit 20. The refrigerant in the indoor unit 20 is decompressed by the indoor expansion valve 39 and then flows in the indoor heat exchanger 32.

In the indoor unit 20, indoor air blown out of the indoor fan 30 passes the indoor heat exchanger 32 to exchange heat with the refrigerant. The refrigerant in the indoor heat exchanger 32 is evaporated by absorbing heat from the indoor air. The indoor air is cooled by the refrigerant.

The air cooled by the indoor heat exchanger 32 is supplied into an indoor space. The refrigerant evaporated in the indoor heat exchanger 32 is sucked into the compressor 12 to be compressed again.

(2-2) Heating Operation

During heating operation, the four-way switching valve 15 depicted in FIG. 1 is in the state indicated by broken lines, and the compressor 12, the indoor fan 30, and the outdoor fan 16 are in the operating state. The refrigerant circuit C thus achieves a refrigeration cycle in which the indoor heat exchanger 32 functions as a condenser and the outdoor heat exchanger 13 functions as an evaporator.

Specifically, a high-pressure refrigerant compressed by the compressor 12 flows in the indoor heat exchanger 32 of the indoor unit 20. In the indoor unit 20, indoor air blown out of the indoor fan 30 passes the indoor heat exchanger 32 to exchange heat with the refrigerant. The refrigerant in the indoor heat exchanger 32 radiates heat to the indoor air. The indoor air is heated by the refrigerant.

The air heated in the indoor heat exchanger 32 is supplied into the indoor space. The refrigerant condensed in the indoor heat exchanger 32 is decompressed by the outdoor expansion valve 14 and then flows in the outdoor heat exchanger 13. The refrigerant in the outdoor heat exchanger 13 absorbs heat from outdoor air to be evaporated. The refrigerant evaporated in the outdoor heat exchanger 13 is sucked into the compressor 12 to be compressed again.

(3) Installation Position of Gas Sensor (3-1) Relationship Between Height Position of Gas Sensor 55 and Time Until Leakage Detection The conditions of the installation position of the gas sensor 55 are 1) maintenance is possible and 2) refrigerant leakage can be detected.

Regarding 1), in one or more embodiments, an optimal installation position is where a service person can work, the control board 501 is in vicinity, and the opening 241 is in vicinity.

Regarding 2), when a refrigerant having a higher specific density than air leaks from the indoor heat exchanger 32, it can be easily estimated that the refrigerant will stay in the drain pan 36 below the indoor heat exchanger 32, and thus the gas sensor 55 may be installed in the drain pan 36. However, in order to prevent water from splashing on the gas sensor 55, it is conceivable to install the gas sensor 55 above the wall surface of the drain pan 36.

In such a case, when the height position of the gas sensor 55 is inappropriate, it is assumed that time from a start of the refrigerant leak until the leaked refrigerant reaches the height position of the gas sensor 55 becomes long, or the leaked refrigerant does not reach the height position of the gas sensor 55 and is not detected by the gas sensor 55.

Therefore, the applicant(s) identifies a relational expression between the height position of the gas sensor 55 and the time from the start of the refrigerant leakage until the leaked refrigerant reaches the height position of the gas sensor 55, and, the height position of the gas sensor 55 is set on the basis of the relational expression.

Specifically, the gas sensor 55 is installed above the drain pan 36, and a height H from an upper end of the drain pan 36 to the gas sensor 55 is set to satisfy a relational expression represented by $$L\cdot W\{C1\cdot H1/Q+C2\cdot H/(Q-C3\cdot L\cdot H\hat{}(3/2))\}\leq 90, \text{ where}$$

constant C1: 0.0067, constant C2: 0.01172, constant C3: 0.000153,

L [m]: a length of the first wall surface of the drain pan 36,

W [m]: a length of the wall surface of the drain pan 36 intersecting the first wall surface, H1 [m]: a depth of the drain pan 36, and Q [m^3/s]: a refrigerant leakage flow rate.

In the above expression, L·W·H1/Q represents time until the inside of the drain pan 36 is filled with the refrigerant, and is a value obtained by dividing an internal volume of the drain pan 36 [L·W·H1] by a "refrigerant leakage flow rate Q per unit time of the leaked refrigerant". The flow rate is a volumetric flow rate. $Q=1.90131\times10^{-5}$, which is a value obtained by converting a lower limit of a leakage rate of R32, 0.42 g/s, with a density of R32 at a temperature of 0° C., 22.09 [kg/m^3].

L·W·H/(Q−L·H^(3/2)) represents time from when the inside of the drain pan 36 is filled with the refrigerant until the refrigerant overflowing from the drain pan 36 reaches the height H. Constants C1, C2, and C3 are flow rate coefficients.

The refrigerant overflowing from the drain pan 36 accumulates along the side plate of the casing 22, but since the casing 22 is opened to the blow-out port 37, the refrigerant converts its potential energy into kinetic energy and flows out.

The refrigerant located at a higher position than the drain pan 36 is an accumulation of a refrigerant corresponding to a flow rate obtained by subtracting [a flow rate q of the outflowing refrigerant per unit time] from the "refrigerant leakage flow rate Q per unit time of the leaked refrigerant".

Here, [the flow rate q of the outflowing refrigerant per unit time] differs depending on an amount the refrigerant accumulated on the drain pan, and is thus obtained by integration.

The "height H to the gas sensor 55" is a vertical distance from the upper end of the drain pan 36 to a center of the cylindrical pipe 552*b* protecting the sensor element.

The depth H1 of the drain pan 36 may not be uniquely identified because shapes of a bottom surface and an opening surface of the drain pan 36 do not match in some cases. In this case, the depth H1 is substituted by an average depth.

The numerical value 90 on the right side of the inequality sign in the relational expression adopts an upper limit of allowable time until a gas concentration at the position of the gas sensor after the start of leakage exceeds a set value in the IEC standards (IEC60335-2-40).

(3-2) Verification

Figure 5:
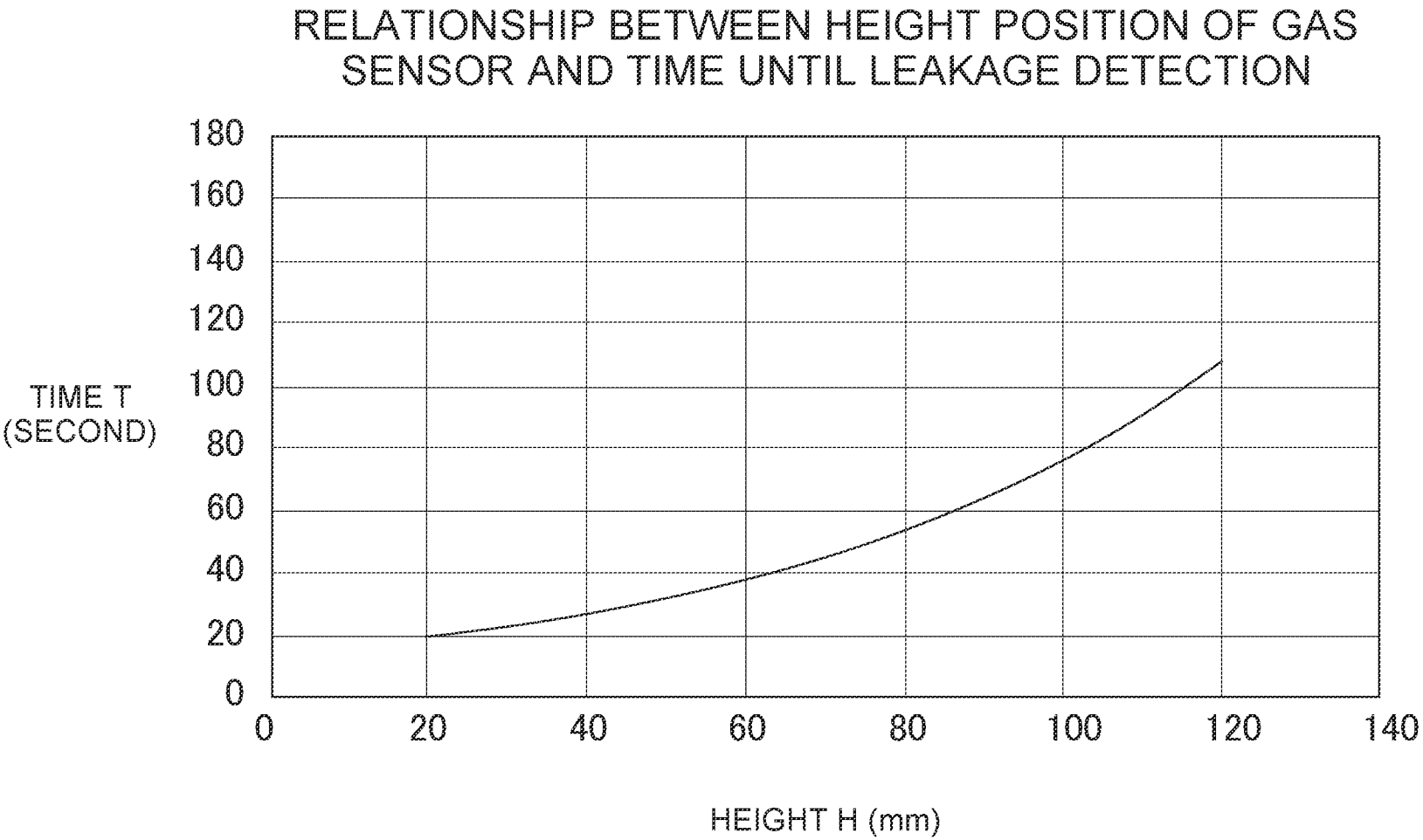
FIG. 5 is a graph showing a relationship between a height position of the gas sensor and time until leakage detection.

FIG. 5 is a graph showing a relationship between the height position (height H) of the gas sensor 55 and time T until leakage detection, a horizontal axis represents the height H from the upper end of the drain pan 36 to the gas sensor 55, and a vertical axis represents time from the start of the refrigerant leakage until the leaked refrigerant is detected by the gas sensor 55.

According to the graph in FIG. 5, the time T until leakage detection is 90 seconds or less in a range where the height H is 110 mm or less. In one or more embodiments, the height H is set to 80 mm or less while ensuring a margin of 20% of a theoretical value.

By setting the gas sensor to satisfy a relationship between representative dimensions of the drain pan 36 (length L, width W, and average depth H1), the refrigerant leakage flow rate Q, and the time until the leaked refrigerant reaches the position of the gas sensor 55 (height H) represented by the relational expression, the refrigerant leakage can be detected at an early stage.

(4) Characteristics (4-1)

In the indoor unit 20, the relationship between the representative dimensions of the drain pan 36 (length L, width W, and average depth H1), the refrigerant leakage flow rate Q, and the time until the leaked refrigerant reaches the position of the gas sensor (height H) is clear. Therefore, the position of the gas sensor (height H) can be set appropriately.

Especially, when the gas sensor 55 is installed above the drain pan 36, the refrigerant leakage can be detected at an early stage by setting the height position (height H) of the gas sensor 55 to satisfy a relationship represented by the above expression.

(4-2)

In the indoor unit 20, an installation location of the gas sensor 55 is close to the control board 501. In general, the control board 501 is installed at a place where the service person can easily work in consideration of work efficiency during maintenance such as replacement. Therefore, by installing the gas sensor 55 close to the control board 501, the work efficiency during maintenance such as replacement of the gas sensor 55 is improved.

Further, since the installation location of the gas sensor 55 is close to the control board 501, a length of a wire electrically connecting the gas sensor 55 and the control board 501 is shortened, which has an advantage of reducing a material cost.

(4-3)

The control board 501 is installed closer to the collection tube than the connection tube 324 of the indoor heat exchanger 32.

(4-4)

The control board 501 is disposed along the side plate 24 or the partition plate 28.

(4-5)

The gas sensor 55 is installed at a position where the service person can attach and detach the gas sensor 55 through the opening 241 when the lid 25 is opened, and the service person can replace the gas sensor 55 through the opening 241 without removing the second side plate 24 of the casing 22 from the casing 22, which improves maintainability.

(4-6)

The gas sensor 55 is installed below the indoor heat exchanger 32.

(4-7)

The indoor unit 20 further includes a plurality of gas sensors 55, and the plurality of gas sensors 55 are installed at a plurality of different locations.

(4-8)

The gas sensor 55 is covered with the case 56 provided with the first opening 561 for ventilation. The case 56 can exert two functions of protecting the gas sensor 55 and introducing the leaking refrigerant.

(4-9)

The gas sensor 55 includes the sensor unit 552 and the wiring unit 553. The gas sensor 55 is installed such that at least a part of the wiring unit 553 is below the sensor unit 552.

(5) Modifications (5-1) First Modification

The above embodiments relate to installing the single gas sensor 55. However, the present disclosure should not be limited to this aspect. Alternatively, the indoor unit 20 may further include a plurality of gas sensors 55, which are installed at a plurality of different positions.

Figure 6A:
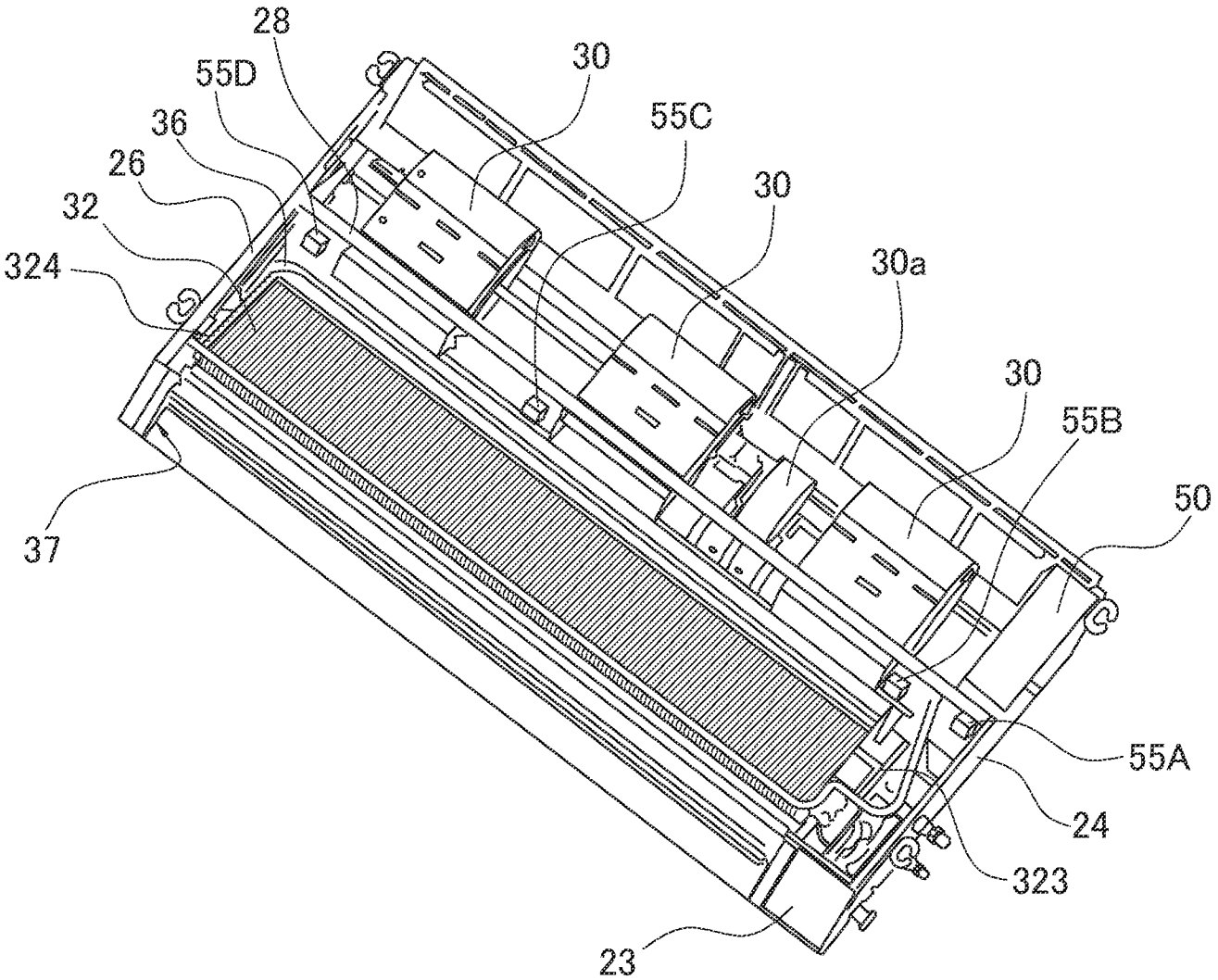
FIG. 6A is a perspective view of an indoor unit according to a first modification when viewed from above.
Figure 6B:
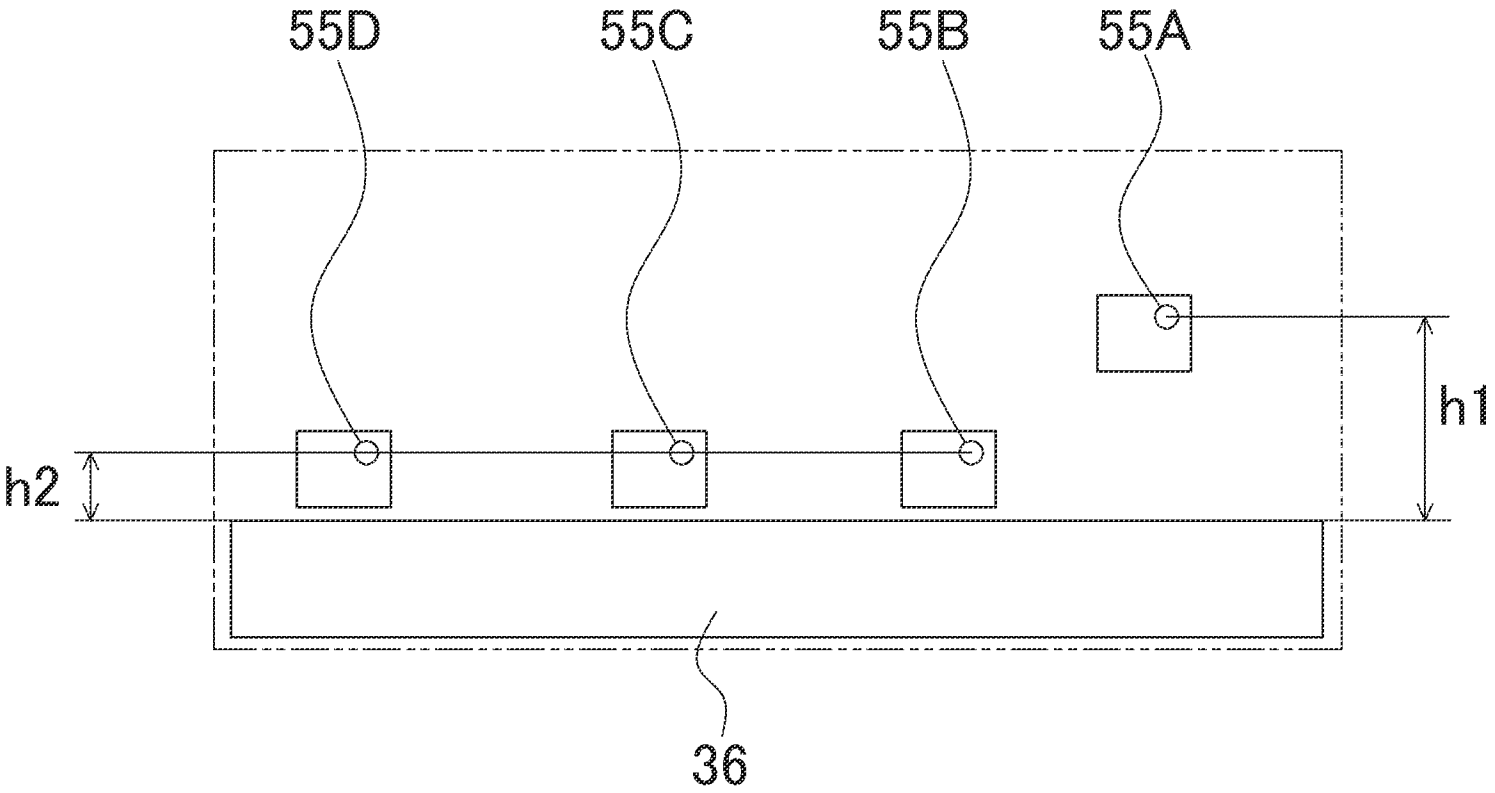
FIG. 6B is a schematic front view of a drain pan in FIG. 6A when viewed from a blow-out port.

FIG. 6A is a perspective view of the indoor unit 20 according to a first modification when viewed from above, and shows the installation position of each gas sensor 55 when the plurality of gas sensors 55 are installed. FIG. 6B is a schematic front view of the drain pan 36 when viewed from the blow-out port 37, and shows the installation position of each gas sensor 55 when a plurality of gas sensors 55 are installed.

In FIGS. 6A and 6B, the four gas sensors 55 are installed at different locations along the partition plate 28 in the first chamber R1.

For easier description, the four gas sensors 55 include a first gas sensor 55A, a second gas sensor 55B, a third gas sensor 55C, and a fourth gas sensor 55D.

Here, the first gas sensor 55A is installed at a height position of h1 (for example, 60 mm) from the upper end of the drain pan 36 at a location close to the electric component box 50. The second gas sensor 55B is installed at a height position of h2 (for example, 20 mm) from the upper end of the drain pan 36 at a location close to the collection tube 323 of the indoor heat exchanger 32. The third gas sensor 55C is installed at a height position of h2 from the upper end of the drain pan 36 at a center of the drain pan 36. The fourth gas sensor 55D is installed at a height position of h2 from the upper end of the drain pan 36 at a location close to the connection tube 324 of the indoor heat exchanger 32.

In such a case, any of the gas sensors can detect the refrigerant within 90 seconds after the start of the refrigerant leakage.

The first gas sensor 55A and the second gas sensor 55B are closer to the control board 501 and the opening 241 of the second side plate 24 than the third gas sensor 55C and the fourth gas sensor 55D.

Thus, the service person can replace the first gas sensor 55A and the second gas sensor 55B through the opening 241.

The service person can replace the first gas sensor 55A and the second gas sensor 55B without removing the second side plate 24 from the casing 22, which improves maintainability.

The third gas sensor 55C and the fourth gas sensor 55D are installed along the blow-out port 37 while maintaining the height position of h2 from the upper end of the drain pan 36, and thus are located below the indoor heat exchanger 32 and above the upper end of the drain pan 36.

(5-2) Second Modification

The above first modification exemplifies the installation position of the plurality of gas sensors 55, but there is no need to simultaneously use all the gas sensors 55 thus installed. With exemplary reference to FIGS. 6A and 6B, only the first gas sensor 55A may be used initially and the second gas sensor 55B may be switchingly used before the first gas sensor 55A terminates its durability life cycle.

The first gas sensor 55A can be switched at timing that can be exemplarily determined in accordance with guarantee years of the gas sensor 55A. The first gas sensor 55A may alternatively be switched to a subsequent gas sensor 55 when abnormality different from refrigerant leakage is assumed in accordance with an output signal of the first gas sensor 55A.

In a similar manner, the second gas sensor 55B, the third gas sensor 55C, and the fourth gas sensor 55D may be used in that order.

(5-3) Third Modification

Figure 6C:
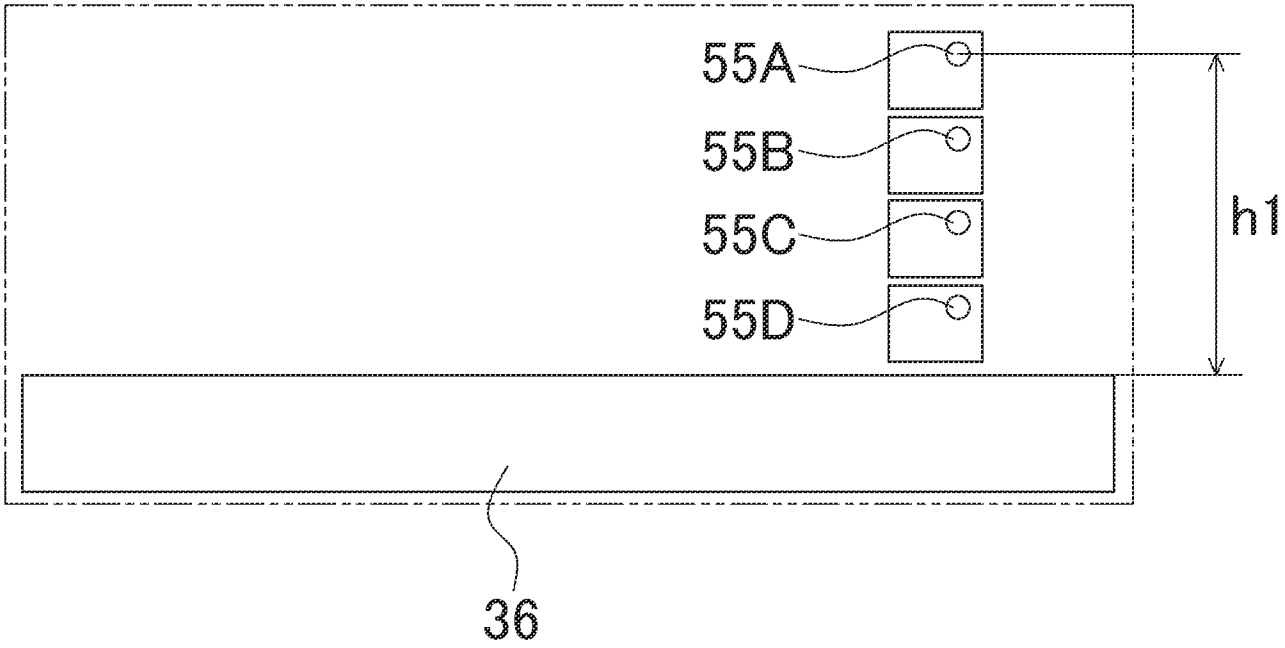
FIG. 6C is a schematic front view of a drain pan when viewed from a blow-out port in an indoor unit according to a third modification.

The plurality of gas sensors 55 may alternatively be installed vertically. FIG. 6C is a schematic front view of the drain pan 36 in the indoor unit 20 according to a third modification when viewed from the blow-out port 37, and the first gas sensor 55A, the second gas sensor 55B, the third gas sensor 55C, and the fourth gas sensor 55D are installed vertically.

However, the first gas sensor 55A installed at a highest position is to be capable of detecting the refrigerant within 90 seconds after the start of the refrigerant leakage. Therefore, the first gas sensor 55A is installed at the height position of h1 (for example, 60 mm) from the upper end of the drain pan 36.

Assumed examples of a method of use include a first aspect of connecting each of the first gas sensor 55A, the second gas sensor 55B, the third gas sensor 55C, and the fourth gas sensor 55D to the control board 501 to be in use, and a second aspect of connecting only one of the gas sensors to the control board 501 to be in use.

(5-3-1) First Aspect

In the first aspect, when a refrigerant leaks, any of the first gas sensor 55A, the second gas sensor 55B, the third gas sensor 55C, or the fourth gas sensor 55D installed vertically detects a refrigerant leakage. Thus, in case any of the gas sensors is in trouble, the other gas sensors detect the refrigerant leakage. This configuration achieves early detection of refrigerant leakage.

Furthermore, in the first aspect, when the refrigerant leaks, after elapse of a predetermined period from occurrence of refrigerant leakage, all the gas sensors operating normally detect refrigerant leakage. Any gas sensor not detecting refrigerant leakage after elapse of the predetermined period can thus be determined as being abnormal.

(5-3-2) Second Aspect

In the second aspect, only the first gas sensor 55A among the first gas sensor 55A, the second gas sensor 55B, the third gas sensor 55C, and the fourth gas sensor 55D is exemplarily connected to the control board 501 to be in use, whereas the other gas sensors are not in use.

Since the second gas sensor 55B, the third gas sensor 55C, and the fourth gas sensor 55D are stored below the first gas sensor 55A, when the first gas sensor 55A is in failure, a service person has only to connect any of the gas sensors 55B to 55D to the control board 501 in place of the first gas sensor 55A to complete replacement of the gas sensor.

The service person can thus replace the gas sensor when visiting for repair without carrying any gas sensor for replacement.

(6) Others

The embodiments and the modifications described above refer to the air conditioner as an exemplary refrigeration apparatus. However, the present disclosure should not be limited thereto. Examples of the refrigeration apparatus include, as well as the air conditioner, a low temperature warehouse storing articles that need to be frozen, refrigerated, or kept at low temperature.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

10: air conditioner (refrigeration apparatus)
20: indoor unit
22: casing
23: first side plate
24: second side plate
25: lid
26: third side plate
27: fourth side plate
28: partition plate
30: fan
32: indoor heat exchanger (heat exchanger)
32*a*: first end
32*b*: second end
36: drain pan
37: blow-out port
55: gas sensor
56: case
241: opening
322: heat transfer tube
323: collection tube
324: connection tube
361: first wall surface
501: control board
552: sensor unit (detector)
553: wiring unit (wire)
561: first opening (opening)
562: second opening (opening)
R1: first chamber
R2: second chamber

PATENT LITERATURE

Patent Literature 1: JP 2019-11914 A

The invention claimed is:

1. An indoor unit of a refrigeration apparatus comprising:
a drain pan that:
comprises four wall surfaces including a first wall surface, and
has a quadrangle shape in a plan view;
a heat exchanger disposed above the drain pan and through which a combustible refrigerant, having a larger specific gravity than air, flows;
a fan that generates air flow to the heat exchanger;
a gas sensor that detects refrigerant leakage; and
a casing accommodating the drain pan, the heat exchanger, the fan, and the gas sensor, wherein
the casing comprises:
side plates, including a first side plate, that constitute side surfaces of an outer contour of the casing;
a partition plate that divides an internal space surrounded by the side plates into a first chamber in which the drain pan is disposed and a second chamber in which the fan is disposed; and
a blow-out port disposed in the first side plate,
the first side plate faces the first wall surface of the drain pan,
the wall surfaces of the drain pan other than the first wall surface are arranged along the side plates or the partition plate, and the gas sensor is disposed above the drain pan and satisfies $$L \cdot W\{C1 \cdot H1/Q + C2 \cdot H/(Q - C3 \cdot L \cdot H^{(3/2)})\} \leq 90,$$

where

C1=0.0067,

C2=0.01172,

C3=0.000153,

H is a height of the gas sensor from an upper end of the drain pan in [m],

L is a length of the first wall surface of the drain pan in [m],

W is a length of a wall surface of the drain pan intersecting with the first wall surface in [m], H1 is a depth of the drain pan in [m], and Q is a refrigerant leakage flow rate in [$m^3/s$].

2. The indoor unit according to claim 1, wherein the indoor unit further comprises a control board, the heat exchanger comprises a first end and a second end, the first end is closer to the control board than the second end is, and the gas sensor is disposed closer to the first end than to the second end.

3. The indoor unit according to claim 2, wherein the heat exchanger comprises:

heat transfer tubes;

a collection tube connected to a first end of each of the heat transfer tubes; and a connection tube connected to a second end of each of the heat transfer tubes, and the control board is installed closer to the collection tube than to the connection tube.

4. The indoor unit according to claim 2, wherein the control board is disposed along one of the side plates or the partition plate.

5. The indoor unit according to claim 1, wherein the casing further comprises:

an opening in one of the side plates; and a lid that closes the opening, and the gas sensor is disposed at a position that is attachable and detachable through the opening when the lid is opened.

6. The indoor unit according to claim 1, wherein the gas sensor is disposed below the heat exchanger.

7. The indoor unit according to claim 1, wherein the indoor unit further comprises a plurality of gas sensors that each detects refrigerant leakage, and the plurality of gas sensors are installed at different locations.

8. The indoor unit according to claim 1, wherein the gas sensor is covered by a case having an opening for ventilation.

9. The indoor unit according to claim 1, wherein the gas sensor comprises a detector and a wire, and the wire is disposed below the detector.

* * * * *